US005620045A

United States Patent [19]

Gerding

[11] Patent Number: 5,620,045

[45] Date of Patent: Apr. 15, 1997

[54] CONTINUOUS CASTING MOLD FORMED OF PLATE ELEMENTS

[76] Inventor: Charles C. Gerding, 8428 Wiese Rd., Brecksville, Ohio 44141

[21] Appl. No.: 426,708

[22] Filed: Apr. 24, 1995

[51] Int. Cl.[6] ..... B22D 11/06

[52] U.S. Cl. ..... 164/430; 164/479

[58] Field of Search ..... 164/430, 431, 164/479

[56] References Cited

U.S. PATENT DOCUMENTS

| | | | |
|---|---|---|---|
| 49,053 | 7/1865 | Bessemer . | |
| 2,383,310 | 8/1945 | Hazelett . | |
| 2,450,428 | 10/1948 | Hazelett . | |
| 2,560,639 | 7/1951 | Giesler et al. | 164/430 X |
| 2,564,723 | 8/1951 | Rossi . | |
| 3,336,973 | 8/1967 | Ratcliffe . | |
| 3,345,738 | 10/1967 | Mizikar et al. | 29/528 |
| 3,437,128 | 4/1969 | Poppmeier . | |
| 3,570,586 | 3/1971 | Lauener | 164/430 |
| 3,627,025 | 12/1971 | Tromel et al. . | |
| 3,747,666 | 7/1973 | Gyongyos . | |
| 3,773,102 | 11/1973 | Gerding . | |
| 4,617,980 | 10/1986 | Banninger | 164/430 |
| 4,682,646 | 7/1987 | Hulek | 164/481 |
| 4,716,955 | 1/1988 | Fastert | 164/475 |
| 4,770,228 | 9/1988 | Artz et al. | 164/430 |
| 4,811,779 | 3/1989 | Streubel et al. | 164/418 |
| 4,926,930 | 5/1990 | Gay et al. | 164/476 |
| 4,951,734 | 8/1990 | Hoffken et al. | 164/455 |
| 4,953,615 | 9/1990 | Hulek | 164/417 |
| 5,133,401 | 7/1992 | Cisko et al. | 164/430 |
| 5,137,075 | 8/1992 | Gerding | 164/263 |

FOREIGN PATENT DOCUMENTS

| | | | |
|---|---|---|---|
| 0237318 | 9/1987 | European Pat. Off. | 164/430 |
| 61-140353 | 6/1986 | Japan | 164/430 |
| 62-207536 | 9/1987 | Japan | 164/430 |
| 62-244555 | 10/1987 | Japan | 164/430 |

OTHER PUBLICATIONS

Samways, N. L. "Nucor Steel, Hickman – 2.2 Million Ton/Year Flat Rolled Minimil" Iron & Steel Engineer–Apr. 1994 pp. 77–84.

Kruger & Streubel "CPR–A Combined Casting/Rolling Process For Producing Steel Strip" Iron & Steel Engineer–May 1995 pp.31–36.

*Primary Examiner*—J. Reed Batten, Jr.

[57] ABSTRACT

The machine has a vertically oriented open-topped mold cavity with downwardly moving sides that contain a pool of liquid metal. The cavity is wide at the top-center and tapers to the narrow thickness of the strip being cast at the sides and bottom. The two wide sides of the cavity are each delineated by a matrix of contiguous plates seperated by narrow fissures. Each matrix is a many-facetted approximation of a doubly-curved surface, the dynamic changes in the shape of which being facilitated by small changes in the relative linear and angular orientation of the plates with each other as they proceed downwardly through the mold cavity

15 Claims, 6 Drawing Sheets

CONTINUOUS CASTING MOLD FORMED OF PLATE ELEMENTS

FIELD OF INVENTION

This invention relates to the general field of apparatus and method for the continuous casting of metal strip between two downwardly moving and converging casting surfaces each formed of a number of articulated columns of casting chill elements of what may be called the caterpillar type. A plurality of columns of these elements form a two dimensional matrix of these elements on each side of the machine which, along with downwardly moving containment surfaces at the ends constrain a casting pool that is wide at the top center and tapers to a constant width at the sides and bottom. Each casting element is comprised of one or more small nested blocks seperated by fissures. The edges of the blocks may be chamfered. Adjustment means are provided to allow minor modification of the contour of the casting surfaces.

DESCRIPTION OF PRIOR ART

Current production methods employ continuous casting in the manufacture of flat-rolled steel. Most of this material is cast from the liquid metal into slabs of form six to fourteen inches in thickness using stationary albeit oscillating molds having a casting cavity of essentially constant cross-section from top to bottom. Solidification is not complete in the mold and the slab exits the bottom with a liquid center. The slab is hen conveyed downward at a constant velocity, between a number of constraining conveyor rolls and is sprayed with water until it is fully solidified.

Such molds must be wide enough to receive a pouring tube or shroud which carries liquid metal from an overhead tundish into the mold, the bottom end of this tube being immersed in the liquid pool at the top of the mold. The minimum thickness that can be cast must be greater than the diameter of the pouring tube.

The fully solidified slab is subsequently reheated and rolled down to a so-called hot-band of fractional inch thickness, these operations requiring a considerable expenditure of energy with expensive equipment.

It has long been known that a plant that could cast thinner slabs would afford considerable savings, both in initial and in operating cost, and in recent years the so-called thin-slab casting has come into use by which slabs of 50 millimeters or so in thickness are produced. This has been made possible by an oscillating mold design, the casting cavity of which is flared out in the center region of the top to accommodate the hot metal pouring tube, and which is tapered inwardly from top to bottom as well as from the center to the sides so that the thickness of the emerging slab is of a smaller dimension than the pouring tube diameter. However, mold friction, sharpness of mold taper, and inertial and bending forces must necessarily limit the thinness of the slab that can be withdrawn from this type of mold.

Various versions of such a mold are described by Rossi in U.S. Pat. No. 2,564,723, by Fastert in U.S. Pat. No. 4,716,955, and by Streubel et al in U.S. Pat. No. 4,811,779. In these Rossi calls for an essentially constant lateral width of mold cavity from top to bottom, while Fastert calls for an increasing width and Streubel et al call for a decreasing one.

Other inventors have devised apparatus over the years to cast metal slabs of much lesser thickness than one or two inches—preferably in the one-quarter inch range. Such a slab can be reduced to a hot-rolled strip of hot band gage (e.g. 1/16 inches) with a minimum of rolling equipment. Such apparatus have come to be called strip casting machines.

There are two basic types of strip casters, one which casts from one side only, yielding a thin strip of generally less than one-eighth inch thickness, one side of which has been frozen against a mold surface, and the other side of which has frozen freely in the melt and/or in the atmosphere just above the melt surface, this latter side tending to be rough in surface texture.

In the other type of machine, both sides of the strip are cast against chill surfaces,the two free sides being subsequently welded together in the machine. I deal here only with the latter type end note that heretofore in most strip casters the two sheets that are welded together to form the two wide sides of the strip are first cast against seperate moving chill means that are either flat or cylindrical and act as the long sides of a reservoir that contains the liquid metal, while various constraining devices are used to contain the ends.

In one style of machine which may be called a variable-gap machine, the distance between the two long sides decreases as the casting proceeds through the machine so that the free sides of the two sheets are eventually pressed and welded together before exiting the caster. Because the liquid adjacent to the downwardly moving surfaces clings to them, a certain amount of liquid metal in the center of the gap is ejected backwardly into the pool by this squeezing action, and the hydrodynamic pressure resulting from this ejection as well as the metalostatic head developed by the liquid metal overhead helps hold the casting against the mold walls. Vertical mold orientation, increased casting length and greater machine speed all contribute to the increase of this desirable pressure.

In another style of machine which may be called a constant gap machine, the two wide sides of the casting cavity are held at a constant spacing from each other so that the two cast sheets grow into each other and solidify as one strip.

A third type of machine which may be thought of as a hybrid uses a constant or converging gap mold in a first stage to form a thin-walled cast shell with a liquid center, after which the two sides of the shell are squeezed together by suitable means to eject the liquid backwardly, thus producing a casting that is thinner that the shell from the first stage.

All of the above designs aim toward a two-sided cast strip that leaves the casting machine with either no liquid in the center or at most small isolated pockets of liquid that fill the interstices left when two irregularly contoured freely-formed cast surfaces come together under the liquid.

Although certain esoteric liquid containment means have been occasionally proposed, (e.g. electromagnetic bath levitation, floating a molten steel sheet on a lead bath), drums, flanged wheels, metal belts, hollow rings, chains of blocks and oscillating stationary surfaces are the commonly used mechanical elements employed as liquid metal containment means in most strip casting machinery, all of which are typically water-cooled. Examples of these elements used in various combinations abound in the strip casting patent literature.

For example, Bessemer in U.S. Pat. No. 49,053 describes a machine in which two proximate drums with parallel centerlines on a common horizontal plane are rotated oppositely so as to roll two cast sheets together downwardly, these sheets having been cast on the surfaces of the drums from a liquid metal pool of trumpet-shaped cross-section contained between them. The gap between the two drums at their closest point (sometimes called the "nip") determines the strip thickness. Blocking the ends of the pool against metal outflow is a problem with this machine as unwanted freezing of metal tends to occur on the surfaces that are required to dam the ends. Also, if solidification is less than complete at the nip or at some portion thereof, excess liquid may come through, while total solidification before the nip either spreads the rolls or jams the machine.

A number of strip casting machines have been devised which are addressed to solving the problems of the Bessemer machine. One form of such apparatus replaces one of the casting drums with a large hollow ring (essentially turning one of the drums inside out) or with an arcuately disposed flexible belt to imitate the lower portion of such a ring, and supplies edge-dams in the form of internal flanges so that a pool of molten metal can be retained in the bottom of the arc. The other drum is placed inside the ring, a lower portion of it being dipped in the pool, so that a converging casting gap and a nip are delineated. The ring and drum are run together to form a two-sided casting which has the cross-sectional shape of a channel. Hazelett in U.S. Pat. No. 2,383,310 and in U.S. Pat. No. 2,450,428, Tromel et al in U.S. Pat. No. 3,627,025 and Gerding in U.S. Pat. No. 3,773,102 and in U.S. Pat. No. 5,137,075 all disclose versions of such apparatus. However, in all of these designs the channel flanges or "ears" must be trimmed from the casting and recycled at considerable expense.

Hazelett in U.S. Pat. No. 2,450,428 also describes a combination of drum and endless flexible belt in which a straight portion of the belt is bent up to contain a pool in cooperation with a drum with shaped ends. Although the curved edges of the casting as they form may see some small local change in curvature due to the flexing of the belt as it approaches the nip, Hazelett intends the geometry to be equivalent to non-flexing containment surfaces cited in other embodiments of the same invention. His effective mold length and hence the casting speed are necessarily small.

In all of the cited strip casting machinery in which two sheets are solidified on seperate surfaces of constant but greatly different curvature before being pressed together, the problem of each of the sheet castings tending to hold the curvature at which it was cast exists, thus encouraging seperation of the two sheets after they pass the nip of the caster if liquid still exists in any region of appreciable size between the two sheets.

A preferable two-sided casting machine concept is one in which the two seperately cast sheets are held together at a constant spacing for a finite time while the final solidification that would weld them together is completed, an advantage inherent in all constant gap machines. For example, Gyongyos in U.S. Pat. No. 3,747,666 describes one of many block casters in which a lower series of mold blocks which are linked together chainwise face a similar upper series of blocks to form a smooth casting channel of constant gap, a wide groove being cut in the bottom blocks which defines the width and thickness of the strip. However, cheap and effective means for feeding liquid steel into a long and thin gap have not yet been found, and block casters of this type are limited to the casting of lower melting metals.

A block caster with a variable gap is described by Hulek in U.S. Pat. No. 4,682,646. Here the blocks defining the ends of the casting cavity slide into grooves in the blocks defining the long sides, thus allowing a converging mold cavity. Since the narrow sides of his casting are squeezed between the wide sides appreciably during the casting process, the reduction of thickness in his mold is necessarily limited.

Apparatus has been proposed in which a liquid filled shell is cast in a first stage, the liquid being subsequently squeezed out backwardly by rolls or other means in a second stage. Hulek in U.S. Pat. No. 4,953,615 describes such a device having a vertical casting cavity of constant lozenge-shaped cross-section formed by two endless chains of blocks in which a shell with a liquid core is cast, the casting then being squeezed into a flat-sided strip of constant cross-section. Strength considerations of his liquid-cored shell appear to limit the minimum strip thickness to about 16 millimeters. Pierre Gay, et al in U.S. Pat. No. 4,926,930 describe a similar arrangement but with the shell being cast in an oscillating mold. Again, shell thickness and speed limitations appear to limit productivity.

Hoffken in U.S. Pat. No. 4,951,734 reduces the casting thickness in a converging and oscillating mold, and continues the reduction by squeezing the liquid-containing sides of the strip together downstream of the mold. The resulting half-inch thick strand is limited to a slow (⅓ meter per second) velocity.

Another feature of continuous casting machinery is the texture of the casting surfaces. Conventional stationary (albeit oscillating) strand casting mold surfaces are gene rally smooth and are lubricated with a flux or fusible mold powder since the casting must slide on them. For mold surfaces that move with he casting, other than smooth and/or lubricated surfaces are allowable, and may be preferable. Knurled, scored, dimpled and other treatments have been applied to promote freezing uniformity.

Since the temperature of a mold casting surface rises as it exracts heat from the casting, it has a tendency to expand although this expansion is mollified by the rigidity of the mold structure. At the same time, the casting as it grows thicker tends to contract, the result being that the casting tries to break away from the mold. This may happen unevenly so that certain areas may remain in better contact with the mold than others, resulting in uneven heat transfer over the surface of the one-sided casting which then gets thicker in some spots than in others. Again, gasses can be released from a metal as it solidifies which may also lead to uneven heat transfer. Mizikar et al in U.S. Pat. No. 3,345,738 recognises these difficulties and proposes various surface treatments to mollify these effects including scoring in one or two directions and also knurling.

A matter of concern with all moving mold casting machinery is the cyclic heating and cooling of the mold which is most severe at the mold surface. If the mold surface is that of a thick structure the interior of which sees relatively little cyclic temperature change, then the growth of the surface material on heating which would occur if the surface were free to expand is restrained and the surface material is forced to forge into itself compressively. In the cooling part of the cycle this material then restretches and after many of such cycles may crack, resulting in a pattern of uncontrolled and undesirable connected fissures (called heat checks) on the mold surface.

Various forms of expansion slots to control this unwanted surface working have been suggested by Poppmeier in U.S. Pat. No. 3,437,128 and by others. Poppmeier asserts that hot metal will not generally penetrate a slot of less than 0.8 millimeters in width.

Cisco et al in U.S. Pat. No. 5,133,401 calls for a pattern of similar slots in his caterpillar mold plates and also recognises the tendency for such mold plates to bend convexly toward the casting side during operation, thus causing the plate edges to be undesirably deformed by forces from adjacent plates.

SUMMARY OF THE INVENTION

It is an object of this invention to provide apparatus and method for casting a wide and essentially fully solidified strip of fractional inch thickness at a velocity of at least one meter per second, so that it may be directly rolled to hot band gage with a minimum of conventional rolling equipment. This strip may have embossings on the surface which are to be rolled out in the first rolling pass. Another object is to recieve liquid steel from a conventional tundish and pouring tube for conversion to strip. Additional objects are to allow a means of machine startup requiring no conventional dummy bars, and to furnish a means of dynamic adjustment of the cross-sectional shape of the cast strip.

A further object of the invention is to provide a relatively thin and light-weight mold construction which will see a minimum of thermal stress during thermal cycling and which will hold the surface of the strip while it is being formed so that the self-stretching Of the freezing metal due to restrained thermal contraction will be essentially uniform across the casting surface. Also, since the downwardly moving strip exiting the machine is thin and easily bent to a small radius, the mold need be suspended only a few feet above ground level as compared to the greater height of conventional strand casting equipment.

Since this invention produces a thin two-sided casting at a high discharge speed and at a temperature considerably above that desirable for direct rolling, the strip may be cooled by appropriate heat absorbing apparatus such as a bank of waste-heat boiler tubes prior to its delivery to the first rolling stand, the invention thus providing opportunity for further energy savings over and above that afforded by apparatus producing slower and thicker castings which conventionally require soaking furnaces with positive heat input prior to the first rolling stand.

These and other objects and attributes are achieved by my invention as hereinafter describred. Although this description refers to steel as the material being cast, it is to be understood that the invention may be applicable to other materials as well.

The apparatus, herinafter called a mold or a machine is for the casting of wide and thin metal strip, and consists in part of a generally vertically oriented casting cavity that contains a pool of liquid and the enveloping casting solidifying therefrom. The center portion of the surface of this cavity is broad at the top and narrows both with depth and also as the ends of the pool surface are approached, horizontal cross-sections of the pool having a cigar or a spindle like shape that becomes narrower as the section is taken further down the mold. Some distance from the bottom the two sides become essentially parallel to each other and spaced apart at a distance essentially equal to the thickness of the strip being cast.

The actual shape of the casting cavity of the invention is a many-facetted approximation of the open-purse cavity just described, each wide side of which is formed by a plurality of contiguous facets which are the mosaic-like elements of the casting surface and which may have irregular edges. I call each of these facets a plate.

The plates are arranged in a number of vertical columns, a number of these columns being juxtaposed in a successively contiguous manner to form an array approximating a doubly curved surface on each side of the machine. I call this array of columns of plates a matrix.

These plates are preferably rectangular, although other sets of geometrical shapes that can nest together and be subdivided into seperable columns can be used.

It is well known from experiment as well as from the theory of surface tension that liquid metals will not penetrate small fissures of less than a millimeter in width in a mold surface, especially if the mold temperature is much below the solidification temperature of the liquid metal.

It is also well known that if a one piece plate is heated rapidly from one side, the plate will bend convexly toward the hot side due to the thermal expansion of the hot surface interacting with the lack of expansion of the cold surface.

However, the problems incurred in casting higher melting materials such as low carbon steel require the plates to be so small (in order to restrict the width of the fissures) that mechanical support for the large number of columns of moving plates to cast a reasonable width becomes a problem.

In the case where a high temperature liquid metal such as steel is being cast, each plate is preferably made as a composite structure instead of as a single piece, consisting of a number discrete casting blocks mounted on a tray. The blocks subdivide the essentially flat plate surface and may be relatively thin (e.g. 5 mm) or relatively thick (e.g. 15 mm)

The thin blocks are affixed to the tray by short protruberances or pins on the back of each block. This provides a region between the back of the blocks and the tray for the flow of cooling water so that the temperature of the back of the blocks and the tray may be held to a low value during casting. If thick blocks are used, they are of such thickness that the flow of heat will not penetrate the full thickness of the block until such time as the block has traversed the matrix. Thick blocks are affixed directly to or are integral with the tray.

In order for the columns of the plates of each matrix to be so closely spaced that the fissures seperating them are everywhere at most a millimeter wide, the casting cavity must have at every elevation an essentially constant peripheral dimension. For this reason the width of the cavity increases somewhat as the thickness of the central region decreases with advancing depth of the pool. The width of the fissures between plates is small but not necessarily constant, else the array of plates could not approximate the doubly-curved surface.

The blocks of the preferred embodiment that comprise each plate may be square or hexagonal and nest together in a checkerboard, staggered checkerboard, or in a honeycomb fashion with a small fissure everywhere between the adjoining faces of adjacent blocks. The width of these fissures must be great enough to accommodate the surface expansion of each block and yet be small enough so that hot metal will not penetrate the fissure.

The number of columns and number of plates in each column (i.e., number of rows) of the two matrices facing each other are desirably large so that the obtuse angle between plates of adjacent columns is always close to 180 degrees thus minimizing the local unbending of the casting in the vicinity of the fissures as the casting proceeds downwardly through the matrix. Although variable, the width of the fissures between adjacent plates is kept within the small one millimeter value.

Small plate to plate steps on the surface of the matrix in the upper regions of the machine also occur as the plates travel downwardly due to slight plate to plate twisting in all but the central columns of each matrix and these steps are also minimized by a matrix having many plates. The width of the plates is not necessarily the same for all columns.

Other embodiments in which the mosaic is comprised of closely-fitting blocks of other shapes or of blocks which are not all of the same shape are possible, but less practical. An arrangement where the fissures of adjoining blocks meet in three-way intersections is preferred.

Each vertical edge of the cavity is blocked at least for a portion of its length from the top down by a single recirculating column of similar plates or other casting blocks, or by a modification of the plates of the end columns of the wide side consisting of orthogonal appendages so as to wrap around the ends of the casting during its formation.

The lower portions of the edges of the casting cavity are not necessarily blocked by plates or other means since they are normally blocked against the outflow of liquid metal by the recently solidified edge of the casting itself.

In operation the four casting surfaces move downwardly and at a common velocity with the casting as it solidifies from the sides of the stationary albeit turbulent liquid pool. A continuous supply of plates is thus required at the top of the mold cavity to replenish the casting surfaces, and a continuous removal of plates must occur at the bottom. The plates of each column of the matrix are therefore only a portion of a larger number of plates that form a train or circuit so that plates leaving the bottom of each column of the matrix are carried upward to feed plates to the top of the mold via a suitable smooth path.

Each of the plates of each train is mounted on one or more carrier elements. These elements run serially in or on a track, typically of a channel shaped cross-section, that not only holds the column of plates to its appropriate orientation in the matrix but also may guide the train of plates through some portion of its return path. The centerline of this partial loop of track is in general a smooth three-dimensional space curve. The loop of track may be interrupted or supplemented by driving and auxilliary guiding means for the plates and carrier elements.

In order to insure smooth three dimensional curvature of the trains of plates, the tracks diverge away from each other after leaving the matrix at the bottom, and reconverge before they reenter it at the top.

The plates are preferably mounted on the carrier element with one vertical edge of the plate parallel to and essentially over the local centerline of the channel track, the opposite edge of the rectangular plate being supported by one or more lugs engaging the plate of the column adjacent.

In this way any local pressure that may develop from thick places on the casting when the two matrices approach each other will always be supported by reaction forces at both ends of the plate so that the plates will not tend to twist out of position when acted on by random pressures from the casting.

To facilitate the alignment of the plates in adjacent columns with respect to each other, each plate and its respective carrier element are mounted so that the plate can turn by a small angle about a centerline parallel to its local direction of travel. This may be done by hinge mounting the plate to the carrier element, or by the use of a carrier element with a round bottom that slides in a circular groove in the guiding track in which it can also slidably turn.

In combination with travel limiting stops this allows the tray to twist through a narrow angle so that it may line up closely with the tray in the next column by virtue of one or more aligning lugs on the plate that engage slots in the plate of the adjacent column. The divergent columns of plates are essentially "zipped" together as they reapproach each other before entering the top of the matrix.

The twist cited above is a trimming twist and is over and above the static twist in the three dimensional space curve of the channel tracks. It obviates an absolutely accurate angular positioning of the tracks.

In a preferred design, one or more central columns of plates in the matrix see no twisting. These columns are supported on each end by a train of carrier elements, one on each end. The plates have no locating lugs, but are engaged by the lugs of adjacent columns. The plates of these columns may be wider than those of the other columns.

In one embodiment the plate carrier elements are the adapted links of a roller chain, the tray of each plate being attached at one end to the side plates of the so-called pin links and roller links of the chain by hinge means. In this embodiment each train is driven by a sprocket engaging the chain located at the bottom of the loop. The sprockets for the matrix of each side are mounted on and keyed to a common head shaft, and the two head shafts for the two sides of the machine are driven in synchronism albeit in opposite directions. Each chain is directed tangentially by its channel shaped track onto the teeth of its respective drive sprocket. In this embodiment the roller chain is essentially always in tension and means for extending the length of each track so that slack in the chain may be taken up are required.

Another embodiment employs endless loops of steel cable onto which round bottomed carrier elements for the plates of the matrix are clamped at appropriate spacing. These slide and also turn slightly in arcuately grooved tracks so that hinges are not required for fine plate alignment. The strings of elements are driven by a driving wheel similar to a conventional pocket sheave.

Obviously, other types of chains maybe adapted for carrying the plates, as for example a common link chain with the links running in a specially grooved track.

The edges of the blocks may be chamfered or radiused so that a grid of ridges are formed on the casting. The grooves resulting from the chamfers are wide enough at the top to be penetrated to a sizable portion of their total depth by liquid metal. The grooves working in conjunction with metalostatic pressure serve to lock the casting in place as it forms on the mold surface. In this way elongation due to restrained shrinkage that occurs over a wide expanse of surface as the material solidifies and cools is not concentrated in one place resulting in possible localised necking and rupture, but is spread out evenly over the surface. The connected grid of ridges on the casting surface must be rolled out later if a flat product is desired. The grooves are typically only a few millimeters deep.

In another embodiment, the chamfers are eliminated, so that only the fissures of less than one millimeter in width remain between the blocks.

By virtue of their regular distribution over the casting surface, the grooves and to some extent the fissures act as an even deployment of casting surface anamolies. These cause local variations in the thickness of the cast sheet due to the enhanced or diminished local heat transfer. These variations (which tend to occur randomly on castings when no grooves are present) may thus be given a periodic regularity. By a small increase in the width of the casting blocks at the edge of one side of each matrix and a small vertical offset of one matrix relative to the other, the thin places on the casting on one of the two opposing matrices may be made to intermesh with the thick places being cast on the other, thus promoting a more regular freezing of the strip.

The mold has a built-in mechanism to alter the cross-sectional shape (called the profile) of the strip by dynamic adjustment during casting. This is done in a preferred embodiment with shaft-mounted eccentric cams in the lower straight portion of the machine so that the tracks can be elastically deflected a small distance inwardly or outwardly by turning one or more horizontal shafts on which the cams are mounted.

In one such arrangement a number of circular cams, one for each track and of equal diameter but with varying amounts of eccentricity, are mounted on a common shaft on one side of the machine and so arranged that each cam in turning pushes the track toward (and thus squeezes) or pulls the track away from (and thus thickens) the casting in the local vicinity. In general, several such cam shafts are required for at least one side of the machine.

So that the profile of the strip may be varied continuously from a full center to a full edge condition, (i.e. thicker at the center or thicker at the edges), the eccentricity of these cams is greatest for tracks at the center of the casting cavity and decreases to zero for those at the edges so that a quarter turn of a cam shaft in one direction (or the other) moves the adjacent portion of the matrix of plates from a locally plane configuration to one that is inwardly (or outwardly) bowed. The magnitude of the cam adjustments is desirably small.

Other devices than cams can be used to vary the local distance of the opposite mold walls from each other such as horizontal elastic beams on which the raceways are mounted and which can be bowed inwardly or outwardly by appropriate bending moments applied to the beam ends, or, individual adjusting screws or hydraulic cylinders can be employed to set the local position of each raceway.

The machine is preferably operated at least at such speed that the liquid center of the strip extends outwardly to the casting thickness as formed on the narrow edges throughout the entire upper converging section, so that the final welding together of the two sheets occurs entirely in the lower constant thickness or "straight" section.

The roller chains besides being required to bend in the normal way also see a certain amount of twist so that the path of these chains do not lie in a plane but describe a three-dimensional space curve. They also undergo a slight amount of bending in a direction ninety degrees from that in which a roller chain is normally bent.

For the chains to operate smoothly and not experience unreasonable wear, it is desirable that the amount of link-to-link twist and out of plane bending be minimized in the design. A mold with a converging section that is many plates high and of a low aspect ratio (small pool thickness/width) is preferred. Likewise such a mold minimizes the dynamic distortion (unbending) of the casting itself as it proceeds downwardly through the mold.

In each of the two sides of the machine the tracks and the track positioning cams and the bearings for the various shafts are held in place by attachment to frame members. One of the two frames is slidably mounted on a rigid machine base so that it may be moved toward or away from the other to adjust the casting thickness.

During the normal running of the machine, an interval of time occurs between the first contact of the downwardly moving plates at the top of the matrix with the meniscus of the liquid metal pool and the first palpable temperature rise at the cold side of the blocks further down in the mold. It is at this point that cooling water is first applied to the back side of the blocks. For thin blocks this application will be high in the matrix. For thick blocks it will be lower down. In either case, application of water to the casting face of the blocks is delayed until the return side of the loop. The timing of water application is important since water must not find its way through the fissures before solid steel has formed on the surface of the matrix, else dangerous spitting (explosive evaporation of water) may occur.

By not overcooling the plates with the water sprays so that some residual heat remains on the plate casting surface before it re-contacts liquid metal at the top, spitting due to residual water on the plate surface is avoided. Alternately, other evaporating methods such as a blast of warm gas directed at the plate surfaces at the top of the machine may be employed.

It should be obvious to those skilled in the art that there are many possible casting element configurations and many ways of supporting and carrying the casting elements which can achieve the purport of this invention, the essence of which is a pair of downwardly moving matrices of closely proximate casting plates each forming the facetted approximation of a doubly-curved surface and facing each other so as to converge from a centrally wide-mouthed hot metal entry area to a constant width exit area of a length sufficient for essentially complete solidification, and which along with suitably blocked edges define a casting cavity for the production of cast strip.

DETAILED DESCRIPTION OF THE DRAWINGS

Figure 1:
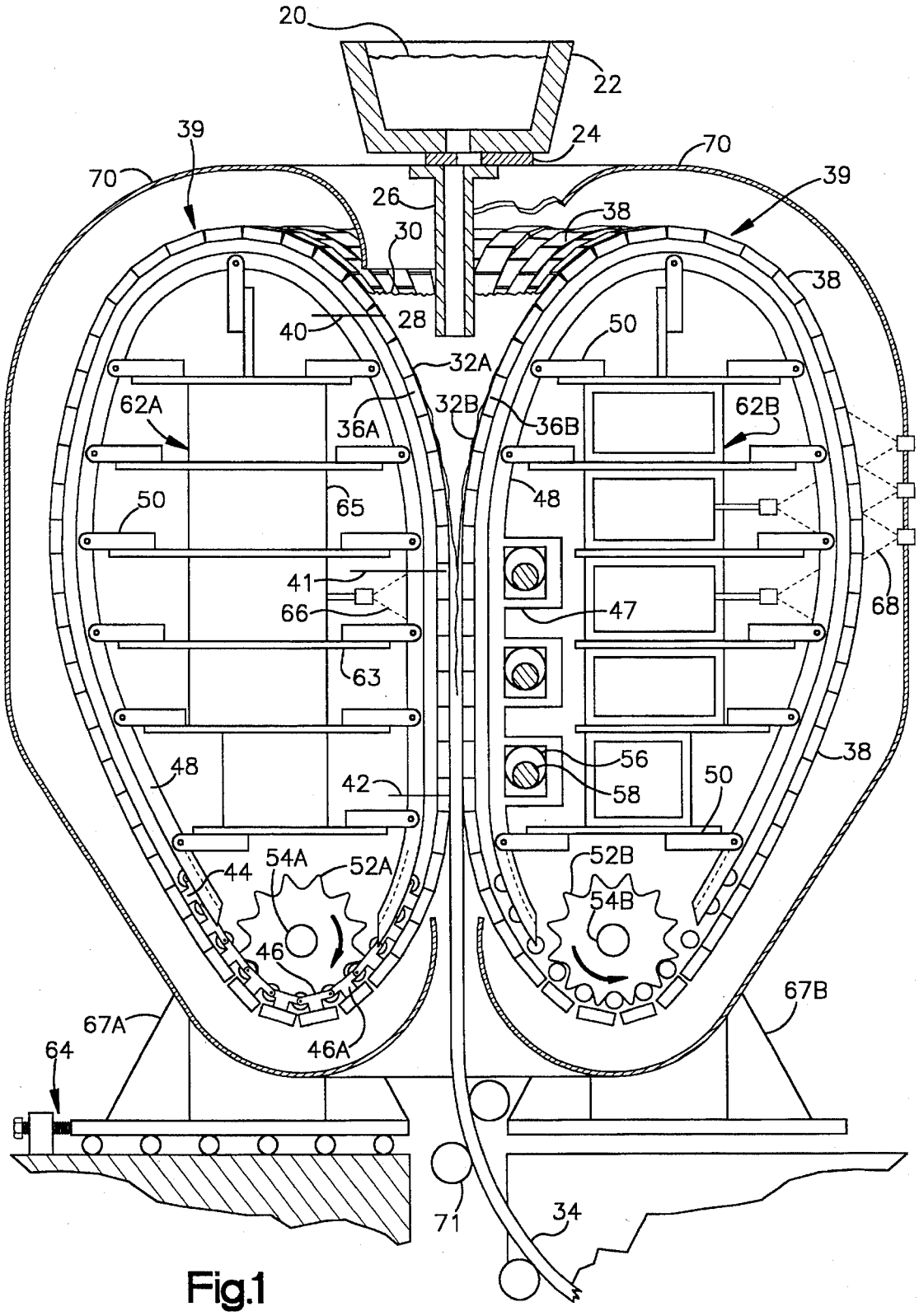
FIG. 1 is a cross-sectional elevation of the roller-chain embodiment taken through the center of the casting machine.

FIG. 1 is a schematic cross-sectional elevation taken through the centerline of the machine embodiment which utilizes a roller chain. Liquid metal supply 20 held by tundish 22 is fed through flow regulating slide gate 24 and pouring tube 26 into pool 28. The pool has surface 30 and continuously solidifying sidewalls 32*a*–32*b* which thicken as they move downwardly to form casting 34, The pool and nascent casting are constrained on both sides by downwardly moving portions 36*a*–36*b* of continuous loops 39 of contiguous casting plates 38. Portions 36*a*–36*b* are arranged in adjacent rows to form a pouchshaped reservoir impenetrable to liquid metal. This consists of a converging section 40–41 where solidification begins and a straight section 41–42 where solidification through the thickness of the strip is completed. Plates 38 of loops 39 are constrained to move in the desired path by plate carriers 44 attached to chain links 46 of roller chain 46*a*. Links 46 run in channel tracks 48 that are attached to machine frame plates 63 by angularly adjustable clamps 50, The ends of the tracks 48 pay chain links 46 onto and off of ganged sprockets 52*a*–52*b*. There is a sprocket for each chain loop and the sprockets for each side of the machine are mounted on common shafts 54*a*–54*b*. These are turned by a drive mechanism (not shown) in the directions indicated thus imparting motion to the chains.

Cams 56 mounted on through cam shafts 58 are rotatable to make small adjustments in the cross-sectional shape of the casting by locally flexing tracks 48 inwardly or outwardly by a slight amount in the general region 41 to 42. Extensions 47 to the tracks 48 box in the cams so that they can move the center tracks inwardly or outwardly to change the shape of the casting. Shafts 58 are mounted on bearings (not shown in this figure) which are rigidly affixed to frame members 62*a*–62*b*. Cams may be provided on either side or on both sides of the machine.

Frame members 62*a* and 62*b* are formed of a stacked assemblage of plates 63 and rectangular tubes 65 and are affixed to vertical stancheons as at 67*a*–67*b* on either end of the machine. Tubes 65 may also serve as conduits for cooling water.

Frame member 62*a* may be moved a small distance toward or away from frame member 62*b* by mechanism 64 to adjust the strip thickness.

Water jets as at 66 supported on frame 62*a*–62*b* are located so as to cool the inside of plates 38 during normal operation as required and also during an emergency stopping of the machine. Water sprays shown typically as 68 mounted on water and spray containment boxes 70 are located so as to cool the casting side of plates 38 during their upward return travel.

Solidified casting 34 is led from the bottom of the machine by guide rolls 71 into conventional flattening and reducing rolls not shown.

Figure 2:
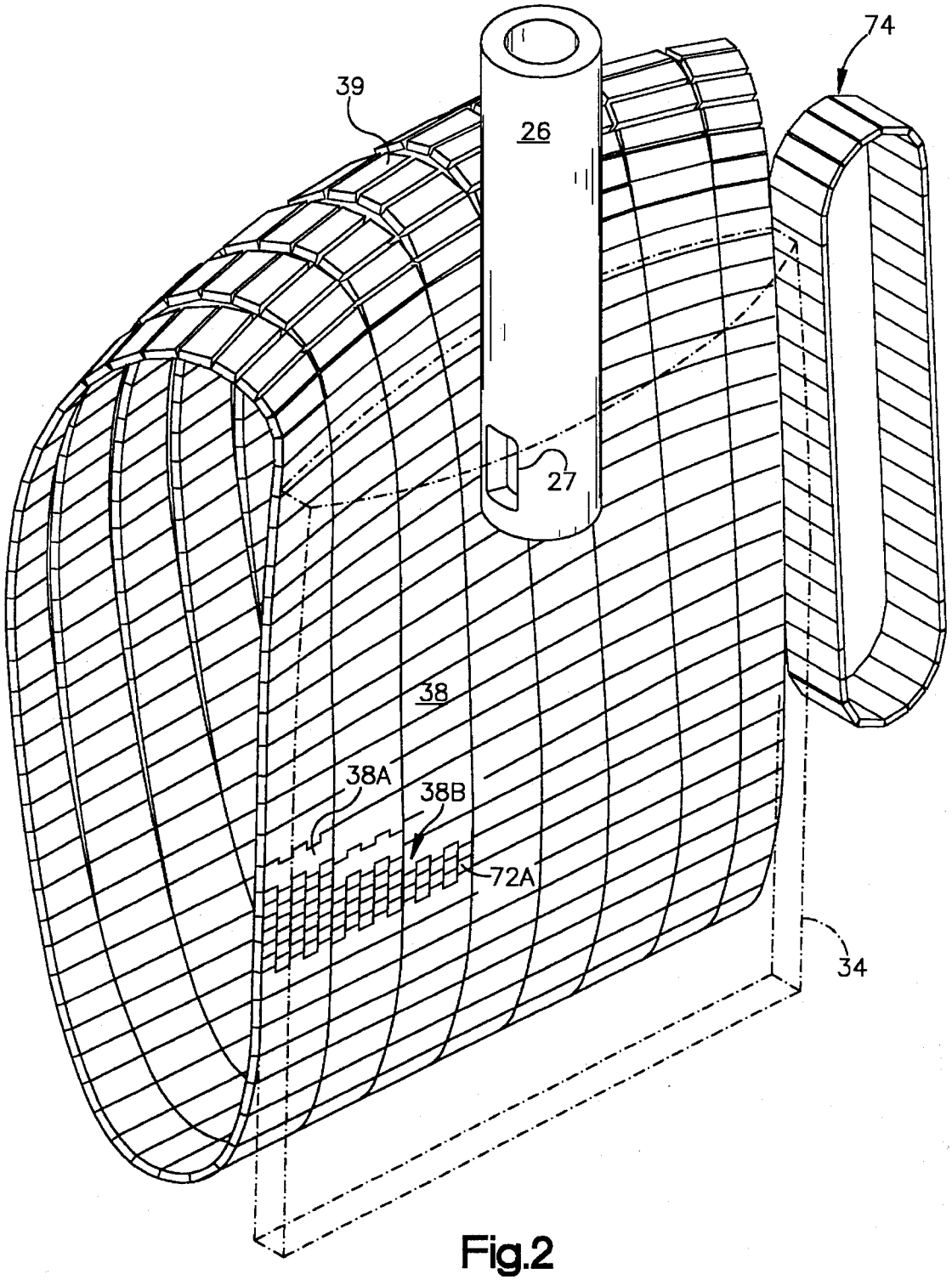
FIG. 2 is a schematic of the spatial arrangement of the loops of plates and feeding tube of the casting machine with the plates of the near half removed and the casting pool shown in phantom.

FIG. 2 is a conceptual schematic cutaway of one half of the machine in which all parts have been omitted except the hot metal feeding tube 26 (shown in part) with lateral discharge holes 27 and the loops 39 of casting plates 38 and train of end containing blocks 74.

For clarity of presentation, the plates 38 are shown as rectangles without subdivision into blocks except where marked 38*a* and 38*b*. At 38*a* a plate is shown in outline, here with staggered top and bottom edges. At 38*b* it is shown with its surface subdivided into an assemblage of ten square blocks 72*a*, five wide by two high. The plates may be comprised of blocks that are staggerd horizontally or vertically, or lined up in checkerboard fashion.

The loops of plates 39 which in part form the columns of the casting matrix are shown with plates 38 adjacent in contiguous columns so that they form a checkerboard pattern. Alternately this pattern may be staggered by advancing every other column by some fraction of the height of a plate.

The pool 28 and the resulting casting 34 contained by the machine is shown in phantom. Each end of the pool is contained by an endless train of end blocks 74.

Figure 3:
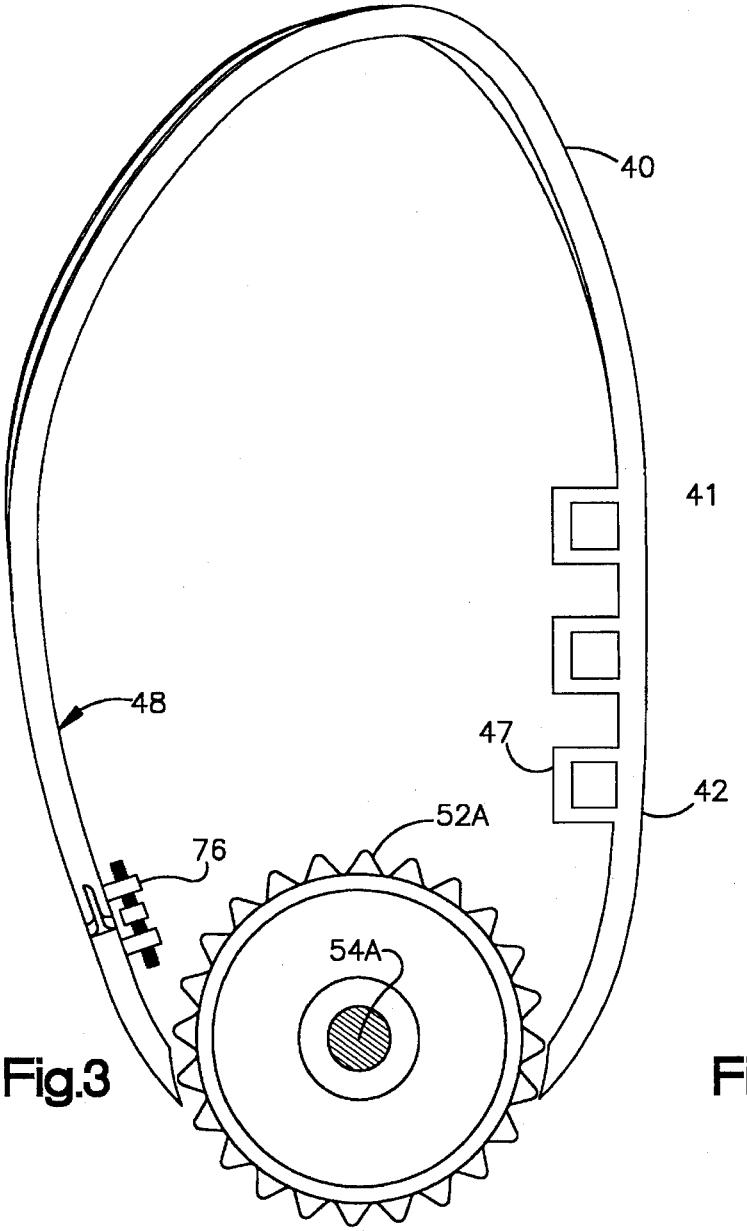
FIG. 3 is a side-elevational view of a typical track showing its three-dimensional twist.
Figure 3A:
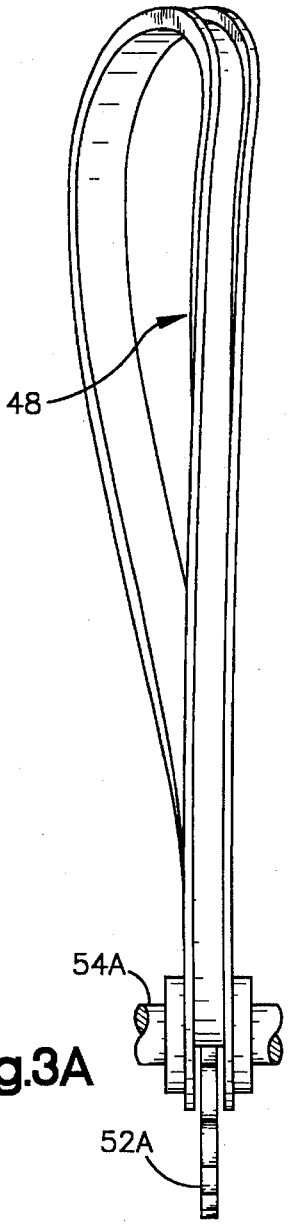
FIG. 3A is a front-elevational view of the track of FIG. 3.

FIG. 3 shows a side elevation and FIG. 3A shows a front elevation of an isolated single channel track 48. Taken together they exaggeratedly illustrate typical three dimensional track curvature required to a greater or less degree for forming the matrix of plates on each side of the mold. The tracks further from the mold center have increasing three dimensional curvature and are either curved as shown for one side of the matrix or are of opposite hand for the other. All but several straight tracks that may be used in the center of the machine and the tracks carrying the end blocking plates are so curved.

A track lengthening device 76 is used to tighten the chain. Cam box extensions are shown at 47.

An embodiment employing a different chain guiding method than that of FIGS. 3 and 3A is shown schematically in FIG. 4 in which again only half of the machine is depicted. Here the roller chains in loops represented by lines 46*a* carry plates 38 and are guided by tracks 48 only in the region in back of the matrix. The chains are otherwise positioned by the top idler sprockets 80 which are seperately born by free running bearings on bent axle 81 and by the chain tightening sprockets 82. The chains are driven by ganged sprockets 52*a* keyed to head shaft 54*a*.

Figure 4A:
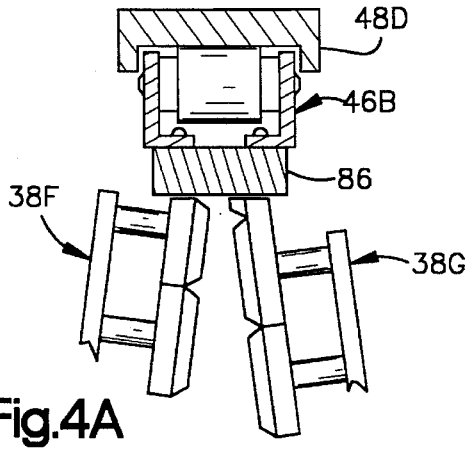
FIG. 4A is a partial cross-section through the machine edge showing the end-blocking plates.

A continuous loop of end blocking plates 86 are supported and driven similarly to the plates of the matrix by idler sprocket 88 and driving sprocket 90. FIG. 4A shows a partial section taken at I of FIG. 4. Here the adapted mold plate assemblies 38*f* and 38*g* at the outer edge of the matrix are shown abutting one of the blocks 86 of train 74. Blocks 86 are carried on links of roller chain 46*b* which runs in stationary track 48*d* supported by framework not shown.

Figure 4B:
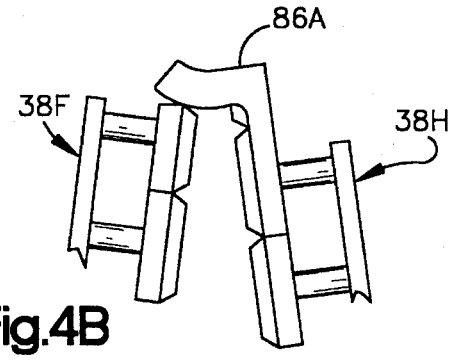
FIG. 4B is a section similar to that of FIG. 4A showing an alternate method of end containment.
Figure 4:
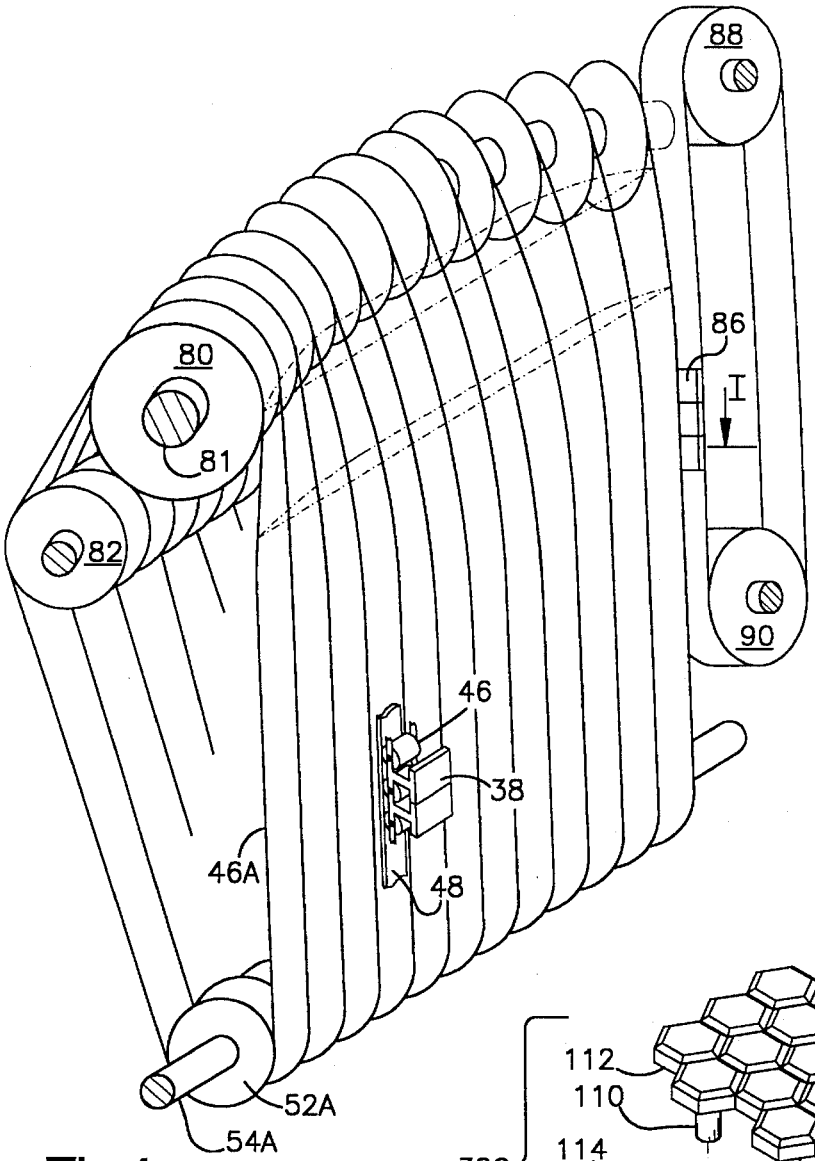
FIG. 4 is a schematic in essence showing an embodiment in which portions of the tracks of FIG. 1 are replaced with guiding sprockets and unguided spans.

FIG. 4B shows an alternate method of casting edge containment using an appendage 86*a* to the otherwise standard casting plate 38*h*.

Figure 5:
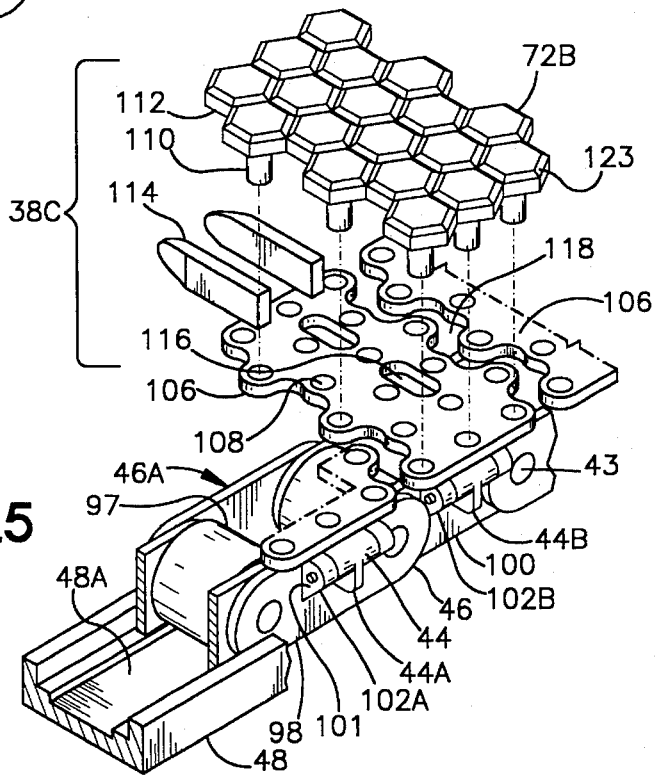
FIG. 5 is an exploded view of several plates, trays and carrier elements of a roller chain embodiment.

Details of the preferred embodiment of the invention which utilizes a roller chain running in a channel track as described in FIGS. 3 and 3A is shown in FIG. 5 in an exploded view. The several links of chain 46*a* illustrated are adaptations of a conventional large roller conveyor chain with pins 43 and side plates 98 of the (wider) pin links, and side plates 100 of the (narrower) roller links. Chain rollers 97 run on surface 48*a* of channel shaped track 48. Short and long hinge brackets 102*a* and 102*b* attached to side plates 98 and 100 respectively carry hinge pins 101 which pivotally locate hinge center 44 protuding downwardly from tray 106. Hinge centers 44 have downwardly protruding tabs 44*a* and 44*b* which act as limiting stops to prevent too great an outward movement of the plate by bearing against the sides of chain side plates 98 and 100 respectively.

The several parts of casting plate 38*c* are spaced apart for clarity of presentation. Casting blocks 72*b* are each comprised of a hexagonal head 112 and a stem 110. Tray 106 has holes 108 which receive the ends of stems 110 of casting blocks 72*b*. The stems are affixed to the tray by welding or brazing. Locating lugs 114 mesh loosely with spaces under the heads 112 and between the stems 110 of blocks 72*b* in the adjoining column of plates. Clearances are provided in this loose meshing so that plates in adjacent columns can twist slightly with respect to one another as they travel downward through the matrix.

Slots 116 and open spaces 118 between adjacent trays are provided to allow water to enter and leave the region between the heads of the blocks 112 and the trays 106.

Figure 6:
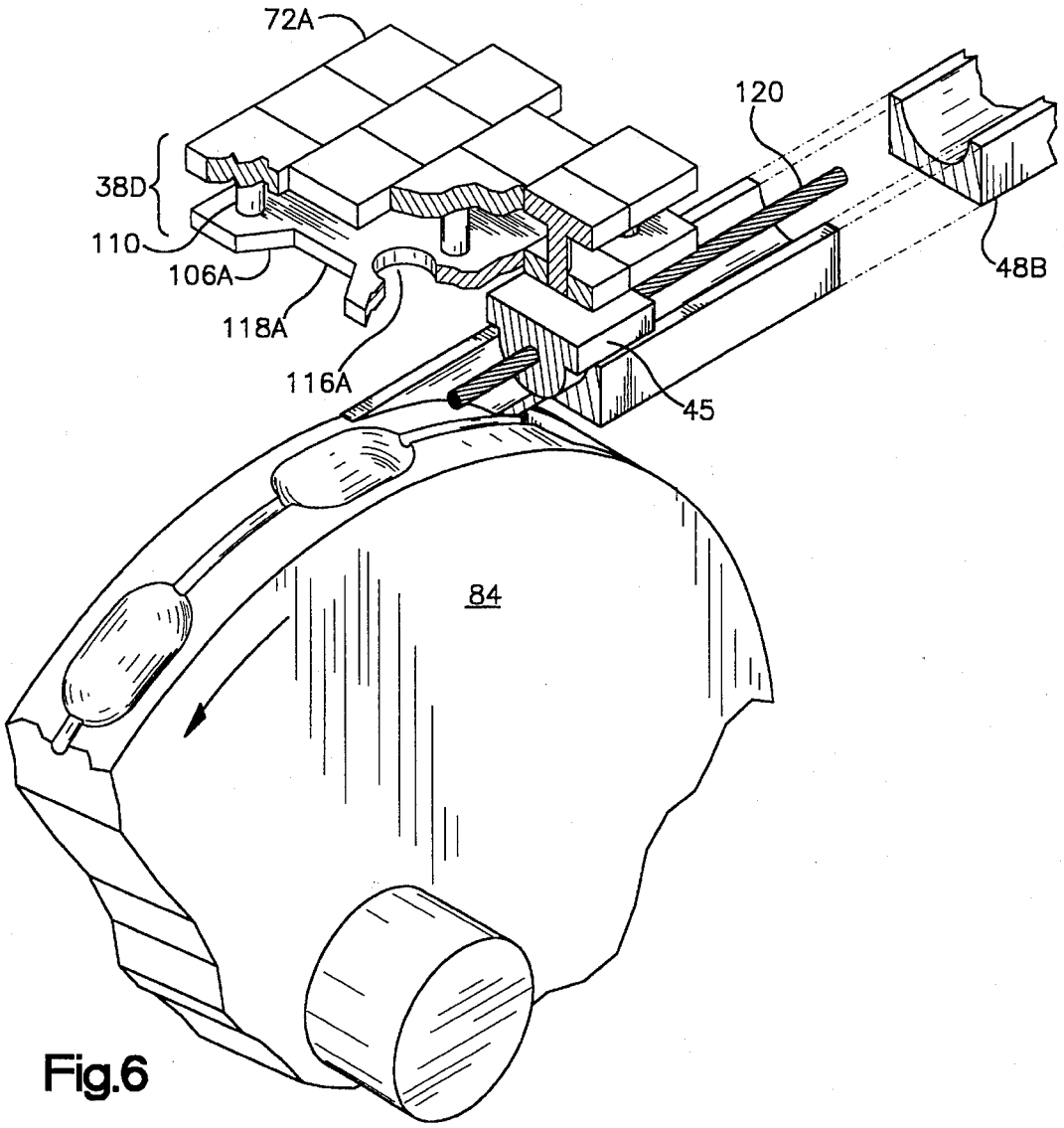
FIG. 6 is a cutaway showing elements connected by a steel cable approaching an adapted pocket sheave.
Figure 6A:
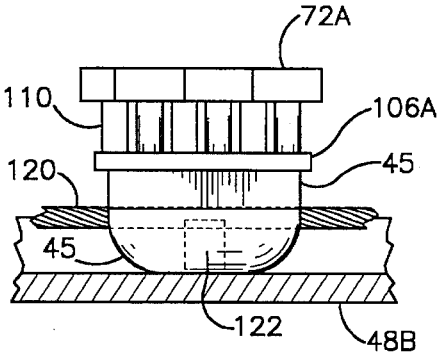
FIGS. 6A and 6B show cross-sections of FIG. 6.
Figure 6B:
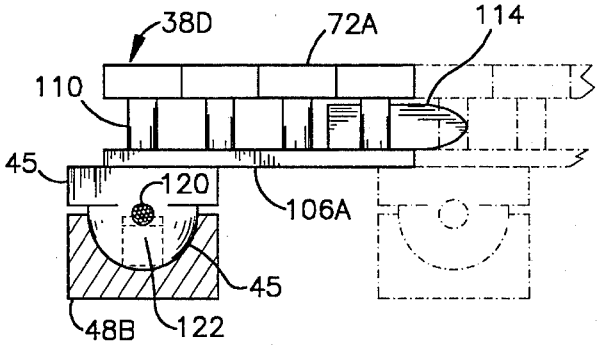

Another loop embodiment which employs a flexible member such as a wire rope rather than a roller chain is detailed in FIG. 6 which is a cutaway of one plate carrier element approaching its driving pocket sheave 84. FIG. 6A is a section through the track centerline of this embodiment, and FIG. 6B is a cross-section at right angles to the track 48*b*. The track here is a semi-circular trough which in conjunction with the round-bottomed carrier element 45 not only guides the train of plates, but serves the same plate alignment function as do the hinge pins 101 above.

The plate 38*d* is formed of square casting blocks 72*a* spaced from tray 106*a* by stems 110. Plate carriers 45 are strung on the cable 120 at equal spacing and are affixed to the cable by set screws 122 shown in phantom. Locating lugs 114 again assure alignment between horizontally adjacent plates. Holes 116*a* and spaces 118*a* provide water passages for cooling the backs of the casting blocks.

Figure 7:
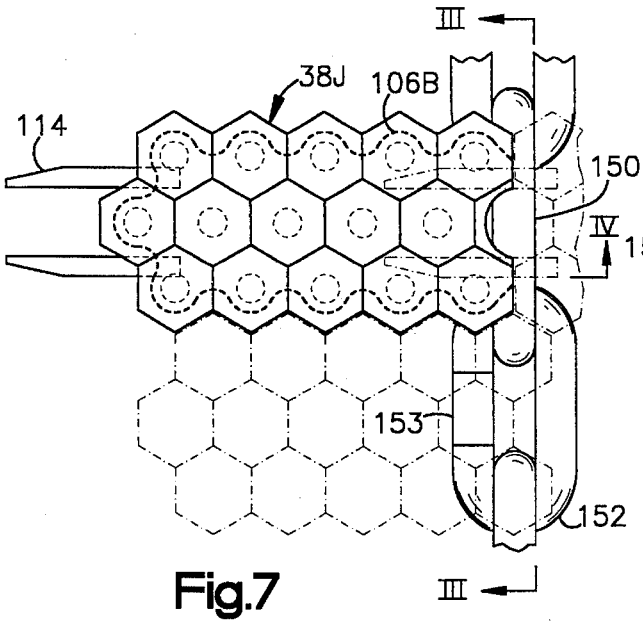
FIG. 7 shows a plan view of plates being carried by the links of a link chain.

FIG. 7 shows compound casting plate 38*j* comprised of casting blocks 72*d*, spacing pins 110, and tray 106*b* mounted on the top edge of a vertical link 150 of an ordinary link chain. An adjacent horizontal link 152 is provided with a stool 153 so as to space the adjacent plate (shown in phantom) at the correct elevation.

Figure 7A:
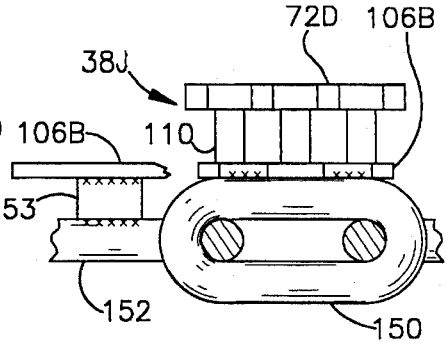
FIGS. 7A and FIGS. 7B are cross-sections of FIG. 7.

FIG. 7A shows a cross-section of FIG. 7 taken at III—III

Figure 7B:
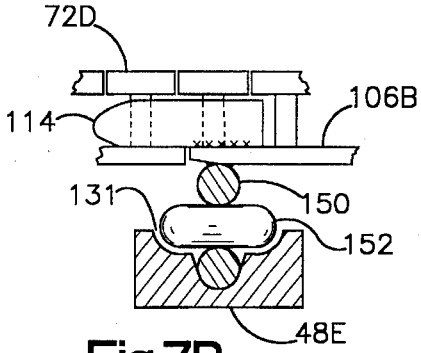

FIG. 7B is a section of FIG. 10 taken at IV showing the engagement of lug 114 with the composite casting plate adjacent and cross-section of track 48*e* with angular travel limit gap 131.

Figure 8:
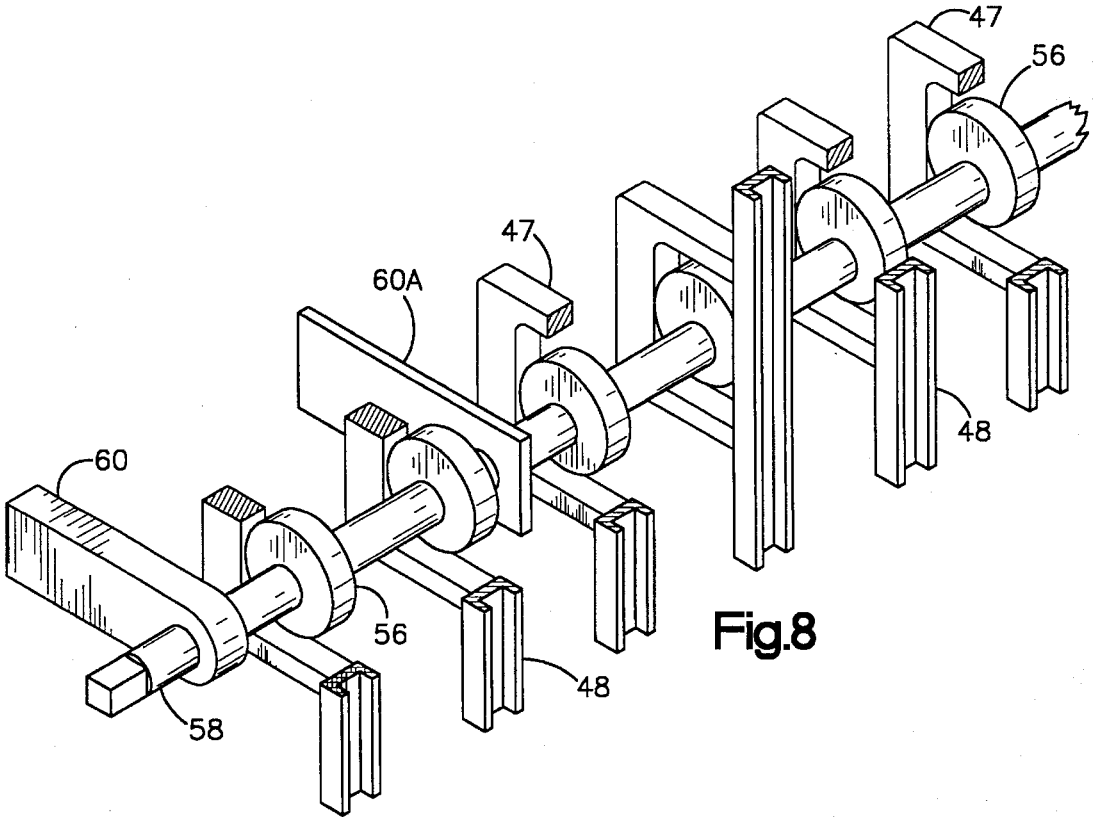
FIG. 8 shows a cutaway of a portion of a contour-adjusting cam shaft.

FIG. 8 shows a portion of cam shaft 58 borne by main bearings 60 at each end and by intermediate bearings 60*a*, all attached to the machine frame. Circular cams 56 are disposed on shaft 58 so as to bear on tracks 48 at the three o'clock position of the cams. Track box extensions 47 bear on each cam face at the nine o'clock position. The cams on shaft 58 are mounted with varying amounts of eccentricity, being concentric at the ends and approaching a maximum eccentricity at the center. With shaft 58 in the neutral position (with the apogee of each cam at 12 o'clock), tracks 48 are all abreast of each other and lie in a plane. By turning shaft 58 clockwise, the plane is distorted, becoming slightly convex. Turning the shaft in the opposite direction makes the former plane concave. By appropriate adjustment of the several cam shafts the cross-sectional shape of the emerging strip may be controlled to a flat, or if desired, a crowned condition. The eccentricity of the cams in FIG. 8 is exaggerated for purposes of illustration.

I claim:

1. A continuous strip casting machine comprising (a) two wide and downwardly moving casting surfaces facing each other, each of said surfaces being comprised of the faces of a plurality of closely nested casting plates forming in their aggregate a matrix, each said matrix being a facetted approximation of a smooth doubly curved surface, said matrices delimiting the wide sides or a casting cavity that contains a pool of molten metal and a casting being continuously frozen therefrom, and constraining the edges of said pool so that the surface of said pool has an elongated shape with a broad thickness at the center region which gradually converges to a narrow thickness at each end, said broader portions at the surface gradually diminishing in thickness with depth so as to converge to a narrow and essentially constant thickness across the entire width of said pool at a distance below the said pool surface thereby defining a converging section, said cavity also having a section of approximately constant thickness for an additional distance therebelow thereby defining a constant thickness section, and (b) two narrow end containment means delimiting the said approximately constant thickness spacing between the edges of the two said matrices, and retaining said pool and casting therein, and (c) driving means to advance said casting plates and solidified portions of said casting adjacent thereto downwardly at an essentially constant velocity, and (d) recirculating means for returning said casting plates from the bottom of said casting cavity so as to re-enter the matrices at the top, and (e) cooling mean to extract heat absorbed by said casting plates from said casting.

2. A casting machine according to claim 1 wherein each of said matrices comprises a number of juxtaposed columns of said casting plates, said plates of each column being a portion of a larger number of plates that comprise a closed and endless train of said plates, all said plates of said train being mounted on or integral with plate carrying means, said carrying means being serially connected with articulated or flexible connecting means to form a loop.

3. A casting machine according to claim 2 wherein each of said trains of plate carrying means are guided in a smooth three dimensional space curve at least in part by some combination of channel tracks, idling wheel means, and driving wheel means which position said casting plates both in their travel downward through said matrix and in a smooth return path.

4. A casting machine according to claim 3 wherein said carrying means are attached at or near one end of said plates, said plates having pivoting means so as to be rotatable about an axis parallel to their direction of travel, the opposite end of said plates being fitted with positioning and load transmitting protuberances which engage the columns adjacent during their said downward travel through said matrix.

5. A casting machine according to claim 4 wherein said plate carrying means comprise the links of a roller chain.

6. A casting machine according to claim 4 wherein said pivoting means comprise hinges attached to said plate carrying means.

7. A casting machine according to claim 4 wherein said plate carrying mean are round bottomed and run in an arcuately grooved track so as to provide said pivoting means and are spaced on a continuous loop of flexible cable and guided at least partly in an arcuately grooved channel track and driven by rotating sheave means.

8. A casting machine according to claim 4 wherein said plate carrying means and pivoting means comprise adapted links of a link chain.

9. A casting machine according to claim 2 wherein said casting surfaces of said plates are each comprised of the outer surfaces of one or more closely nested casting blocks, said blocks being mounted on or integral with a carrier tray such that a fissure of a width less than one millimeter exists everywhere between the adjacent edges of adjoining blocks of a given plate, and where said columns are juxtaposed such that spaces between the edges of the surfaces of adjacent plates in the matrix measure everywhere less than one millimeter.

10. A casting machine according to claim 9 wherein said casting blocks are relatively thin and are spaced from said carrier tray by mounting means of smaller cross-sectional area than the surface area of said plates, thus providing space for the introduction of coolant between said blocks and said tray and partial thermal isolation of said tray from said blocks.

11. A casting machine according to claim 9 wherein said casting block are relatively thick and arm attached directly to or integral with said tray.

12. A casting machine according to claim 9 wherein the edges of the faces of said casting blocks facing the casting are chamfered or radiussed to provide tapered grooves into which said molten metal of the pool partially enters before solidification.

13. A casting machine according to claim 3 wherein said channel tracks are deflectable in the vicinity of said lower portion of said casting cavity by adjustment means so as to adjust the cross sectional profile of said casting.

14. A casting machine according to claim 13 wherein the adjustment means comprise cams mounted on cam shafts.

15. A casting machine according to claim 1 wherein the said two wide casting surfaces facing each other mounted on separate frames, at least one of said frames being movable relative to the other so as to adjust the width of said casting cavity.

* * * * *